US006227413B1

(12) United States Patent
Bommer

(10) Patent No.: US 6,227,413 B1
(45) **Date of Patent: *May 8, 2001**

(54) DISCHARGE APPARATUS WITH ORGANIC COMPONENT ACTIVE AGAINST MICROORGANISMS

(75) Inventor: René Bommer, Radolfzell (DE)

(73) Assignee: Ing. Erich Pfeiffer GmbH, Radolfzell (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/948,754

(22) Filed: Oct. 10, 1997

(30) Foreign Application Priority Data

Oct. 18, 1996 (DE) ..... 196 42 976

(51) Int. Cl.[7] ..... B67D 5/58

(52) U.S. Cl. ..... 222/190; 222/321.2; 222/321.7; 523/122

(58) Field of Search ..... 222/190, 321.2, 222/321.7, 321.9, 189.09, 198.1; 523/122; 428/36.1; 220/454; 604/890.1

(56) References Cited

U.S. PATENT DOCUMENTS

| | | | | |
|---|---|---|---|---|
| 4,721,736 | | 1/1988 | Rei et al. | 523/122 |
| 4,758,609 | | 7/1988 | Rei et al. | 523/122 |
| 4,809,878 | | 3/1989 | Rainey | 222/321.7 |
| 5,277,334 | | 1/1994 | Malinconico | 222/36 |
| 5,360,145 | | 11/1994 | Gueret | 222/190 |
| 5,829,645 | * | 11/1998 | Hennemann | 222/189.09 |
| 5,830,546 | * | 11/1998 | Ehret et al. | 428/36.1 |

FOREIGN PATENT DOCUMENTS

| | | | |
|---|---|---|---|
| 3522788 A1 | | 1/1987 | (DE) . |
| 3734306 A1 | | 4/1989 | (DE) . |
| 4110304 A1 | | 10/1992 | (DE) . |
| 4122868 A1 | | 1/1993 | (DE) . |
| 4230956 A1 | | 3/1994 | (DE) . |
| 4344306 A1 | | 6/1994 | (DE) . |
| 295 18 284 U1 | | 3/1996 | (DE) . |
| 0 113 254 B1 | | 10/1987 | (EP) . |
| 0 473 892 A2 | | 6/1991 | (EP) . |
| 771734 | * | 10/1996 | (EP) . |
| 97/10160 | * | 3/1997 | (WO) . |

OTHER PUBLICATIONS

European search report dated Oct. 9, 1998 in Appln. No. 97117474.3 –2308.

Patent Abstracts of Japan, Pub. No. 04297267, publication date Oct. 21, 1992.

* cited by examiner

*Primary Examiner*—Kevin Shaver
*Assistant Examiner*—Melvin A. Cartagena
(74) *Attorney, Agent, or Firm*—Quarles & Brady LLP

(57) ABSTRACT

A discharge apparatus for media with a medium reservoir and a discharge opening for the medium is at least partly made from a plastic containing at least one substance active against microorganisms. This substance can be an antibiotic, e.g. an antibiotic with bactericidal action from the penicillin group. It is appropriate for the parts of the discharge apparatus coming into contact with the medium to be made from the plastic with additive. Preferably the discharge apparatus is substantially completely made from the plastic with additive. The discharge apparatus according to the invention is preferably used for dosing, feeding, atomizing and/or dispensing pharmaceuticals or cosmetics.

18 Claims, 2 Drawing Sheets

DISCHARGE APPARATUS WITH ORGANIC COMPONENT ACTIVE AGAINST MICROORGANISMS

Figure 1:
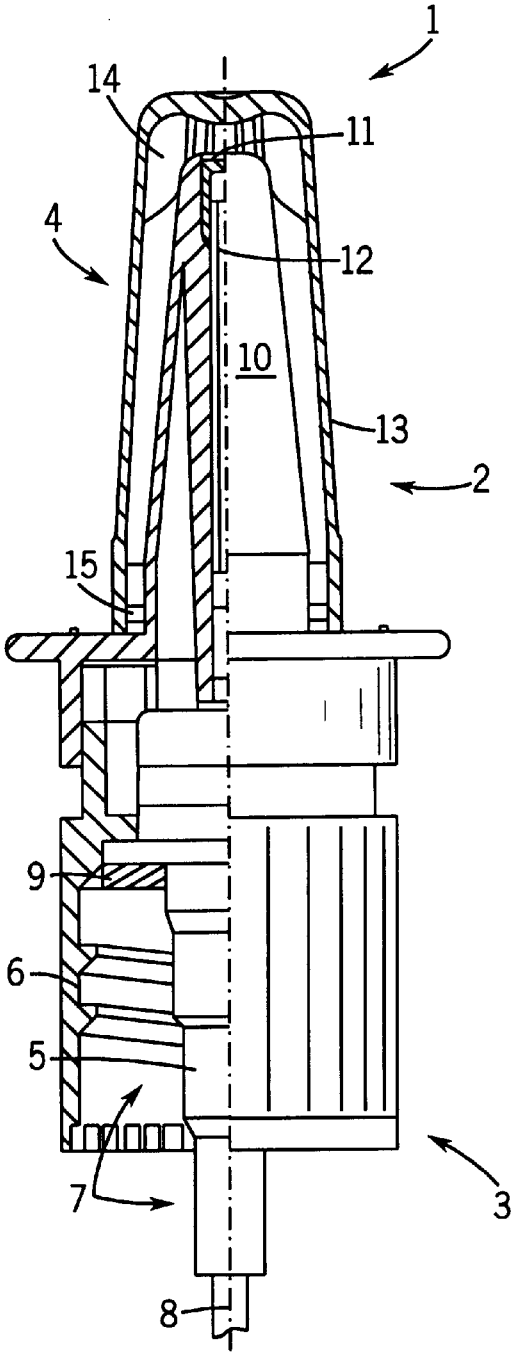

The invention relates to a discharge apparatus for media having a medium reservoir and a discharge opening for the medium.

Numerous designs of such discharge apparatuses for numerous applications are known. They are able to discharge, e.g. dose, feed or dispense gaseous, liquid, creamy, gelatinous, pulverulent and/or solid media. The medium can optionally additionally be discharged in atomized form. A generally known application of such discharge apparatuses is e.g. in the cosmetic or pharmaceutical sector, but they are also widely used in other fields of technology.

Independently thereof, when using the most varied products and goods, a control of microorganisms is necessary or desired. This is normally achieved by the use of disinfectants, preservatives or chemotherapeuticals. It is also possible in this connection to maintain sterile correspondingly endangered surfaces by the addition of germicidal agents to the base material.

In the case of the aforementioned discharge apparatuses with a frequently complicated construction the described problem arises in complex form, because the microorganisms or germs can advance via the outlet opening and the associated guides or tubes into the apparatus, optionally to the reservoir. The same applies with regards to an optionally provided additional tube for a fluid, e.g. air, used for pressure compensation purposes in the reservoir. It has therefore been proposed to use so-called germ barriers, which are either provided for the outlet of the medium or optionally and additionally for the fluid guide used for pressure compensation purposes. Such germ barriers can e.g. be germ filters, which are introduced into corresponding guide lines. Special closures or closing systems for the outlet opening and the tubes or lines connected thereto have already been provided. However, all this requires the use of additional components, which further complicate and render expensive the overall construction. In addition, with the discharge apparatuses of the aforementioned type, to the medium is still added a preservative, which stops or impairs the propagation of microorganisms.

The problem of the invention is to make available a discharge apparatus having the aforementioned features, in which with comparatively simple means a reliable antimicrobial action is obtained. The aforementioned disadvantages of the prior art are to be avoided and in particular it is to be possible to largely avoid the addition of preservatives to the medium to be discharged. In addition, the use of additional components and the constructional expenditure associated therewith is to be avoided.

This problem is solved by a discharge apparatus having the features of claim 1. Preferred embodiments of the discharge apparatus are described in subclaims 2 to 19. The wording of all the claims is made by reference into part of the content of the present description.

The discharge apparatus according to the invention is characterized in that it is at least partly made from a plastic, which as an additive contains a substance active against microorganisms, i.e. an antimicrobial substance. Such active substances are used as disinfectants, preservatives, chemotherapeuticals and antibiotics. To the extent that a "compatibility" exists with the corresponding plastic, it is possible to use all these agents. As a function of the control spectrum and action mechanism the antimicrobial substances are active e.g. against bacteria (bacteriostatics, bactericides) or as antimycotics against fungi (fungistatics, fungicides).

As a result of the important fields of use of the inventive discharge apparatuses antibiotics are preferred as the additive. In known manner these are low molecular weight metabolites of microorganisms, which in small concentrations inhibit the growth of other microorganisms or kill the latter. These antibiotics can either be prepared chemically or biochemically or can be extracted from plants and animals. The corresponding representatives of compounds covered by the definition of antibiotics are known to the expert.

Another preferred group of substances which can be used as an additive are bactericides, i.e antimicrobial agents with a bacteria-killing action. In this case, unlike in the case of bacteriostatics, growth and propagation of bacteria does not resume. Here again the corresponding representatives are known to the expert.

Preference is also given to so-called penicillins as a collective term for bactericidal antibiotics from the culture liquids of various mould fungus species. Here again the corresponding representatives are known to the expert, the action mechanism essentially being based on a blocking of the cell wall synthesis in growing bacteria.

Other representatives referred to here in exemplified manner are halogenated aromatic nitrites or phenol derivatives, particularly brominated and/or chlorinated phenols. A preferred compound is 2,4,4'-trichloro-2'-hydroxydiphenyl ether (Triclosan).

The antimicrobial agent concentration in the plastic can be chosen as a function of the intended use of the discharge apparatus, but is preferably between 0.01 and 1 wt. %, based on the plastic quantity. Within this range quanties of 0.01 to 0.5 wt. % and in particular 0.1 to 0.25 wt. % of active substance are advantageous. The specifically indicated ranges are normally sufficient in order to ensure the necessary action against the appearance and growth of microorganisms. Due to the comparatively high cost of specific microbial agents, the quantity of additive to the plastic is frequently to be chosen as low as possible.

As plastics can fundamentally be used all the corresponding materials which are employed for the manufacture of conventional discharge apparatuses. These can be thermosetting resins. Normally they are thermoplastics, which are processed in a comparatively simple manner, i.e. are e.g. extruded or injection moulded. Known thermoplastics are e.g. polyethylene, polypropylene, polyesters and polyvinyl chloride. It is obviously also possible to use corresponding copolymers for the production of the discharge apparatuses. Preferred plastics in the case of the invention are inter alia polyethylene-polypropylene copolymers, polytetrafluoroethylene PTFE, POM such as acetal copolymers based on trioxan, low and high density polyethylene (PE), polypropylene (PP) and in general ethylene copolymers.

The desired additive concentration in the plastic can e.g. be obtained by directly mixing in the corresponding active substance quantity into said plastic. This generally takes place in the melt, the plastic being subsequently granulatable. In this case directly the plastic is obtained with the desired additive quantity. In another procedure a plastic containing a clearly defined, larger additive quantity, e.g. 10 wt. % is subsequently mixed with a plastic, normally the same plastic, without any additive. This leads to a "dilution", to the actually desired concentration of active agent. The plastics are usually in granulate form. Subsequently the mixture is melted together and either regranulated or directly processed. This second possibility offers the advantage that only a few and optionally only one plastic type with additive must be kept in stock and the actual additive quantity in the plastic can then be varied freely.

As has already been indicated, according to the invention the discharge apparatus is at least partly made from plastic with an active agent addition. It is advantageous and appropriate if the parts of the discharge apparatus which come or can come into contact with the medium, are at least partly made from the plastic with additive. The desired action of the additive then takes place precisely at the decisive points of the discharge apparatus. The parts of the discharge apparatus involved in this connection will be described hereinafter. For example, in the already described apparatuses, at least the medium reservoir and the part carrying the discharge opening can be made from plastic with additive. Preferably only one line for the medium leading to the discharge opening is made from the plastic with additive.

The invention can be implemented in that one or more parts of the apparatus, which in particular come into contact with the medium or on operating the discharge apparatus contact the same, are made from plastic with additive. In the case of said component or components, they are also preferably those which are not vital for the function of the discharge apparatus. Thus, in these embodiments, only those components can be made from plastic with additive, whereas for the remaining functional parts can be used those without additive, i.e. optionally the hitherto used components. The parts not necessary for the discharge function of the apparatus can e.g. be suitable inserts or attachments, with which the medium is in contact or comes into contact during the operation of the discharge apparatus. Thus, the necessary antimicrobial action is brought about by the long lasting or short-term contact with the component. Such inserts or attachments can e.g. be positioned just upstream of or at the discharge opening.

According to a further development, the discharge apparatus according to the invention is so designed that all apparatus parts coming into contact with the medium are made at least partially and preferably completely from the plastic with additive. Thus, the antimicrobial action is obtained at those points which come or can come into contact with the medium.

In other preferred embodiments the discharge apparatus is substantially completely made from the plastic with an addition of antimicrobially active substance. This is the case if the costs for the manufacture of parts and components of the apparatus from plastic with additive are not decisively higher than the costs for the manufacture of parts or components from plastic without additive. In such cases the manufacture of all parts from plastic with additive offers the advantage that different production processes do not have to be carried out and all parts are only kept in stock in a single version.

In this connection the term "substantially" means that only those parts, which must be made as a result of their function or for other reasons from a different material, are not made from the plastic with additive. These can e.g. be functional parts of valves or pumps, such as e.g. springs or balls for valves, which can be made from metal, particularly steel. Also outer parts, which cannot normally come into contact with the medium, such as casings, casing parts, holders, inscriptions or subsequent coatings, can be made from other materials, e.g. plastics without additive.

The discharge apparatuses according to the invention can be used for all the media referred to hereinbefore, e.g. for liquid media also in the form of solutions, for suspensions, gels and powders. It is also possible to discharge lotions, which represent a special preparation form inter alia for cosmetics and dermatics. These are generally aqueous or aqueous-alcoholic solutions or emulsions. As has already been stated, all possible technical application fields are conceivable, particular reference being made to cosmetics and pharmaceuticals. Correspondingly the claimed discharge apparatuses can be random dosing, feeding and dispensing apparatuses, such as e.g. corresponding plastic bottles, including so-called squeeze bottles, as well as pipettes and the like.

Advantageously the discharge apparatus has a pump for discharging the medium, particularly a thrust piston pump. The use of such pumps for such discharge apparatuses is known and is described hereinafter relative to a specific embodiment, which is not to be understood in a restrictive manner. In the sense of the invention preferably those parts of the pump, which come or can come into contact with the medium, are made from plastic with additive. For the aforementioned reasons once again all the existing components of the pump can be made from the plastic with active substance.

It is also advantageous if the discharge apparatus has a discharge head, particularly a so-called dosing head, which has the discharge opening. Here again the components of the head, as described for the pump, can wholly or partly be made from plastic with additive.

In accordance with the exemplified listed use possibilities of the inventive discharge apparatus, with respect to the pump and in particular the discharge head numerous design possibilities exist, whose construction can result in a large number of different components. For example, the discharge head can be a so-called spray head, which atomizes to a greater or lesser extent during discharge the medium to be discharged. All such variants are covered by the invention, provided that the aforementioned features are fulfilled.

According to a further development in the case of the discharge apparatus according to the invention, two units movable against one another are provided. These two units can e.g. be connected by means of a plug-in and/or snap-on connection and form the essential functional part of the discharge apparatus. The two units can be manually moved against one another, particularly accompanied by mutual axial displacement. The said embodiments are manually operable dosing apparatuses or dispensers, such as are e.g. known from the field of cosmetics as dispensers for perfume, shaving cream, soap, toothpaste, etc. and from the field of pharmaceuticals as a medicament spray, e.g. nose spray.

With the said embodiments having two units, preferably a first unit is formed by a discharge head, e.g. a spray head or head for discharging a pasty material, whilst a second unit is formed by a pump, the latter then being associatable with or placeable on the medium reservoir.

Conventional components of a pump, particularly a thrust piston pump, as stated hereinbefore, are e.g. the piston, including optionally an intermediate piston, piston cylinder, sealing sleeve and sealing casing or housing. All these parts can in preferred embodiments be made from plastic with additive. A restoring spring and a ball for the valve seat can be made from steel, but optionally also from plastic with additive.

In the case of a spray head, e.g. for a nose spray, all the components such as the nozzle, adaptor and optionally a subsequently fitted protective cap and which can come into contact with the medium, can and should be made from the plastic with additive.

For the production of a discharge apparatus according to the invention, there are e.g. also a medicament reservoir, optionally seals and a riser, which can all be made from the plastic with additive.

According to a further development additionally and also in the already described embodiments a so-called medium guide can be provided, which ensures the guidance of the medium from the medicament reservoir, optionally to the pump and from the latter to the discharge opening. This medium guide contains at least one discharge channel issuing into the discharge opening. In preferred embodiments only the channel issuing into the discharge opening is made from plastic with additive, e.g. a channel/pipe leading from the pump to the discharge opening. Correspondingly and additionally a so-called fluid guide can be provided, which serves to provide a pressure compensation through a fluid when part of the medium is discharged. This fluid guide has at least one channel for the pressure compensation. Fundamentally parts of the two said "guides" can be simultaneously used as a medium guide and as a fluid guide.

In the sense of the invention the medium guide, at least the discharge channel, preferably also the fluid guide and at least its channel, are made from the plastic with additive.

In the described, preferred embodiments with medium guide, the invention can also be implemented in that a component associated with the discharge channel, which comes into contact with the medium before or during the operation of the discharge apparatus, is made from the plastic with additive. It is an already described component "without function" (for operating the discharge apparatus), which serves as an additional part for obtaining the antimicrobial action. It can e.g. be an optionally cylindrical plastic part, which is inserted in the discharge channel (flow channel), the medium being freed from the microorganisms on flowing through it. In this way all the remaining parts of the discharge apparatus can be made from materials without any addition of active substance.

To increase effectiveness surfaces of parts made from plastic with additive can be structured, particularly e.g. provided with grooves, slots, etc. This enlarges the effective surface available for the discharge of the antimicrobial active substance and therefore its contact with the medium to be discharged. Such a structuring is preferably used if only a few or even a single part or component of the apparatus contains an additive.

As is clear from the description, the inventive apparatus has the advantage that in a simple way an antimicrobial (antiseptic, germicidal) action is obtained. Unlike what has been the case in the hitherto known discharge apparatuses, there is no need to provide one or more constructionally complicated, additional components to prevent the penetration and propagation of germs, or in most cases there is no need, alternatively or additionally, to add a preservative to the medium. Thus, additives, which are unnecessary for e.g. obtaining the desired cosmetic or pharmaceutical action are avoided, which saves on possible additional costs and the harmful side effects of such agents.

The added microbial substances evolve their action directly in contact with the medium, but do not dissolve from the plastic, e.g. do not dissolve in the aqueous and/or alcoholic solutions as are normally used in the cosmetic and pharmaceutical sector. Through the introduction of the active substance into the production material, there is no need to fear wear and consequently a reduction of action, such as e.g. in the case of surface coatings. The added substances normally have a low toxicity, so that their use is unobjectionable.

As has already been stated, the addition of the antimicrobial agent can take place in simple manner by admixing the active substance is a plastic melt, the mixture obtained with the additive being normally regranulated prior to further processing. Then by admixing the granulate with additive to a plastic granulate without additive, the desired active substance concentration in the plastic is obtained. This can take place by a simple mixing of the two granulates (plastic with additive and plastic without additive). If necessary, plastic with additive and plastic without additive can also be mixed in the melt and from same, prior to further processing, a new granulate can be produced with the desired additive concentration. The plastics used with and without additive need not necessarily be the same. Then the components of the discharge apparatus in the case of the conventionally used thermoplastics are produced by extrusion or injection moulding and are subsequently assembled together with optionally present further components made from other materials.

The invention also relates to the use of a plastic, which contains an additive of at least one substance active against microorganisms, for the production of discharge apparatuses for media, as specified hereinbefore and as defined in claim 18. Preferred embodiments are described in the dependent claim 18. The wording of claim 18 is also made by reference into content of the present description.

The described features and further features of the invention can be gathered from the following description of preferred embodiments in conjunction with the subclaims and drawings. The individual features can be implemented singl or in the form of subcombinations. In the drawings show:

FIG. 1 A partial view of an inventive discharge apparatus in partial section with pump and discharge head.

Figure 2:
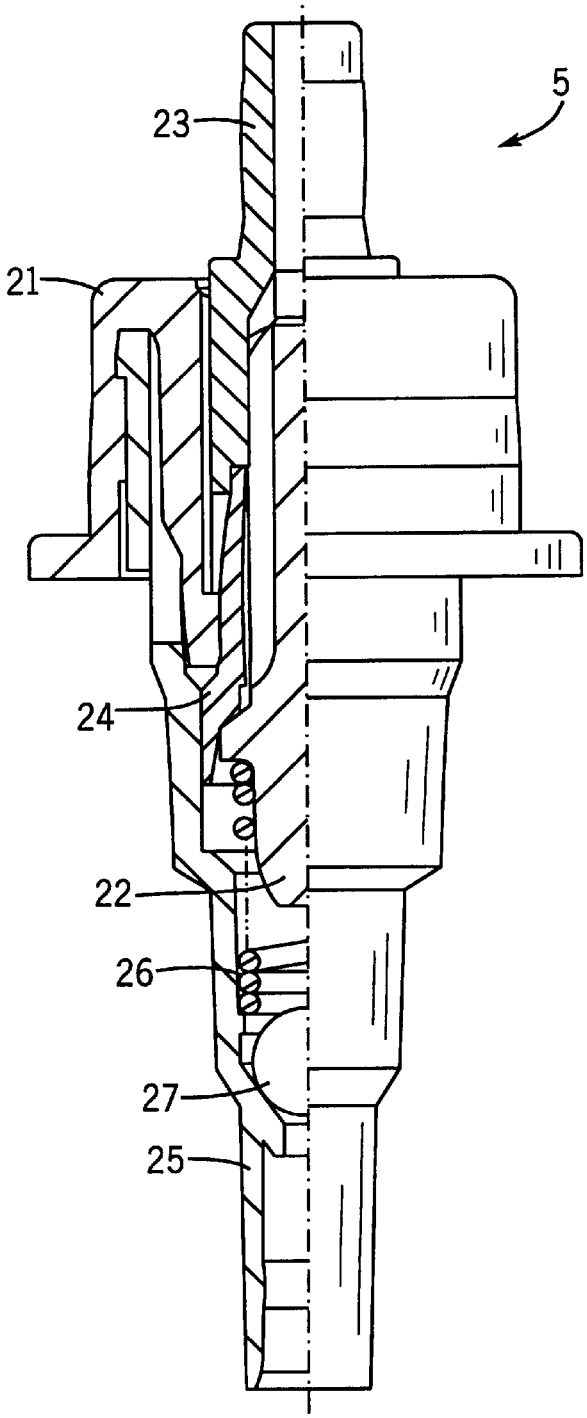

FIG. 2 A part sectional view of the discharge apparatus pump shown in FIG. 1.

With respect to its construction, design and function the discharge apparatus 1 according to FIG. 1 is fundamentally known. Its representation is mainly intended to show which parts of the discharge apparatus are appropriately or preferably made from the plastics material with antimicrobial additive. As has already been stated, the material can be used for numerous different discharge apparatuses, so that the apparatus shown in FIG. 1 and the pump shown in FIG. 2 are only to be understood as examples.

The discharge apparatus 1 according to FIG. 1 has two units 2, 3, which can be manually moved axially against one another. The first unit 2 substantially comprises a discharge head 4 and the second unit 3 a pump 5, which is inserted by means of a casing 6, a corresponding casing part, holder, etc. in a medium reservoir 7 not shown in detail in FIG. 1. The thrust piston pump used as the pump 5 in the present case can suck the medium by means of a riser 8 and discharge it via the discharge head 4 on operating the pump. Between the pump 5 and the upper edge of the medium reservoir 7 is provided a ring seal 9 serving a sealing function in FIG. 1.

In the case of FIG. 1 the discharge head 4 is constructed as a spray head and has as an essential component an adaptor part 10 carrying a nozzle or an integrated nozzle plunger part for the desired application, in the present case for a nose spray. The adaptor 10 also contains the tubes or channels used for guiding the medium and whereof in FIG. 1 only the discharge channel 12 issuing into a discharge opening 11 is shown. For example, additionally at the end of the discharge channel 12 are provided swirl channels in order to ensure a conical discharge. The discharge opening 11 is closed before or after the operation by suitable sealing or closing means, which are preferably associated with the discharge channel 12.

The discharge head 4 according to FIG. 1 also has a protective cap 13, which in the non-use state or at least prior to the initial use is inverted over the adaptor 10 and is held in position there e.g. with the aid of suitable supporting or clamping elements 14, 15.

Of the components of the discharge apparatus 1 shown or described in conjunction with FIG. 1 in particular those which come or can come into contact with the medium to be discharged are made from the described plastic with an additive formed by an antimicrobial agent. In the case of the first unit 2 they are mainly the adaptor 10 with nozzle and the medium-guiding tubes and channels, particularly the discharge channel 12 issuing into the discharge opening 11. The protective cap 13 is preferably also made from the plastic with additive. With regards to the second unit 3, essential parts of the pump 5 are made from plastic with additive, which is shown in FIG. 2. The medium reservoir 7, the riser 8 and also the ring seal 9 can be made from plastic with additive.

As has already been stated in the introduction to the specification, preferably all the components of the discharge apparatus 1 can be made from plastic with additive, because then only one type of component has to be kept in stock. In certain circumstances the casing or casing part 6 need not be made from a plastic with additive, because said part does not normally come into contact with the medium. Obviously it is also possible to use the additive for this component.

Conventional plastics to which the additive can be admixed, as well as their preferred variants are mentioned in the introduction to the specification. Thus, in the case of the first unit 2, the medium reservoir 7 and riser 8 can be made from PE, PP or PE-PP copolymers. The material for the casing can be polypropylene (Hostalen®). The ring seal 9 can also be made from a PE copolymer, such as APRS.

With regards to the discharge head 4, the nozzle part is made from acetal copolymer (Hostaform®), the remainder of the adaptor being made from polypropylene (Hostalen®). The protective cap 13 is preferably made from low density polyethylene (Lupolen®).

The indicated plastics obviously contain according to the invention at least partly the antimicrobial active agent additive.

FIG. 2 shows the pump 5 of FIG. 1 in a larger scale part sectional view. The construction and function of such a thrust piston pump are fundamentally known, so that a detailed description is unnecessary.

FIG. 2 shows all the essential components of the pump 5, namely a (sealing) casing 21 with inner plunger 22 and intermediate plunger 23. It is also possible to see the (sealing) sleeve 24 and the substantially cylindrical lower piece 25 of the pump 5. FIG. 2 also shows a spring 26 and the ball 27 associated with the lower end of the pump 5.

On operating the discharge apparatus 1 partly shown in FIG. 1 by a manual movement of the units 2, 3 against one another, the medium present in the pump chamber is pressed into the discharge channel 12 with the aid of the intermediate plunger 23, sleeve 24 and plunger 22 and after opening the blocking or closing means is discharged through the discharge opening 11, optionally accompanied by atomization. The sleeve under elastic pretension is widened outwards in known manner and consequently intermittently frees the path for the medium out of the pump chamber. When the operating pressure is applied, e.g. by fingers applied to the corresponding contact surfaces, the first unit 2 returns to its starting position and the spring 26 constructed as a compression spring in the pump 5 is responsible for this. By means of the riser 8, medium is subsequently sucked out of the medium reservoir 7 and into the pump chamber. The resulting vacuum is compensated from the outside by the subsequent suction of air, e.g. via gaps present within the components 21 and 25 and which can be closed by the sleeve 24.

In the pump 5 of FIG. 2 all the components can be made from plastic with additive. This in particular applies to the plunger 22, intermediate plunger 23 and sleeve 24, as well as the components 21 and 25. The spring 26 and ball 27 can be made from steel, particularly V2A steel, but also can be made from plastic with additive. In accordance with FIG. 1, for the components are preferably used the following plastics (preferably with additive): plunger 22 and plunger 23 acetal copolymer (Hostaform®), casing 21 and cylindrical component 25 polypropylene (Hostalen®) and sleeve 24 LDPE (Lupolen®).

What is claimed is:

1. Discharge apparatus for media with a medium reservoir and a discharge opening for the medium, wherein the discharge apparatus includes at least one component made from a solidified plastic material comprising an organic substance which is active against microorganisms.

2. Discharge apparatus according to claim 1, characterized in that the substance is a bactericide.

3. Discharge apparatus according to claim 1, characterized in that the substance is a penicillin.

4. Discharge apparatus according to claim 1, characterized in that the substance is present in a quantity of 0.01 to 1 wt. %, based on the plastic quantity.

5. Discharge apparatus according to claim 1, characterized in that the substance is present in a quantity of 0.1 to 0.25 wt. %, based on the plastic quantity.

6. Discharge apparatus according to claim 1, characterized in that parts of the discharge apparatus coming into contact with the medium are at least partly made from plastic with additive.

7. Discharge apparatus according to claim 6, characterized in that all parts of the discharge apparatus coming into contact with the medium are made from the plastic with additive.

8. Discharge apparatus according to claim 1, characterized in that at least one part not necessary for the discharge function of the apparatus is made from the plastic with additive.

9. Discharge apparatus according to claim 1, characterized in that the discharge apparatus is made substantially completely from the plastic with additive.

10. Discharge apparatus according to claim 1, characterized in that the discharge apparatus has a pump, particularly a thrust piston pump.

11. Discharge apparatus according to claim 10, characterized in that at least one component of the pump coming into contact with the medium, is made from the plastic with additive.

12. Discharge apparatus according to claim 1, characterized in that the discharge apparatus has a discharge head having the discharge opening.

13. Discharge apparatus according to claim 12, wherein the discharge head includes the at least one component for contact with the medium, wherein said component is made from the solidified plastic material comprising the organic substance which is active against microorganisms.

14. Discharge apparatus according to claim 1, characterized in that the discharge apparatus has two units movable against one another, wherein the first unit is formed by a discharge head and the second unit by a pump.

15. Discharge apparatus according to claim 1, characterized in that the discharge apparatus has a so-called medium guide with at least one discharge channel issuing into the discharge opening, wherein at least the discharge channel or a component coming into contact with the medium and associated with the discharge channel is made from the plastic containing the additive.

16. Discharge apparatus according to claim 1, characterized in that the discharge apparatus has a guide used for pressure compensation through a fluid and having at least one channel, wherein at least the channel is made from the plastic containing the additive.

17. Discharge apparatus according to one of the preceding claims, characterized in that it is a discharge apparatus for dosing, feeding, atomizing or dispensing pharmaceuticals or cosmetics.

18. Discharge apparatus according to claim 17, characterized in that it is a dosing atomizer for single or multiple use.

* * * * *